United States Patent [19]

Seffens

[11] Patent Number: 4,823,851

[45] Date of Patent: Apr. 25, 1989

[54] INFEED TABLE FOR LUMBER PLANER MACHINE

[75] Inventor: David E. Seffens, Hot Springs, Ark.

[73] Assignee: H. W. Culp Lumber Co., New London, N.C.

[21] Appl. No.: 165,504

[22] Filed: Mar. 8, 1988

[51] Int. Cl.[4] ..... B27B 1/00

[52] U.S. Cl. ..... 144/245 R; 144/245 A; 144/242 E; 144/246 E; 83/422; 83/436; 198/457; 198/624

[58] Field of Search ..... 198/457, 624; 144/242 R, 252 E, 242 M, 245 A, 246 R, 246 E; 83/422, 436

[56] References Cited

U.S. PATENT DOCUMENTS

| | | | |
|---|---|---|---|
| 2,702,570 | 2/1955 | Rothrock . | |
| 2,931,401 | 4/1960 | Lambert . | |
| 2,949,138 | 8/1960 | Card . | |
| 3,120,861 | 2/1964 | Finlay et al. . | |
| 3,990,568 | 11/1976 | Wilson, Sr. | 83/422 |
| 4,063,579 | 12/1977 | Stake . | |
| 4,093,007 | 6/1978 | Hellstrom . | |
| 4,230,218 | 10/1980 | Kunzmann | 198/627 |
| 4,269,245 | 5/1981 | Fornell et al. | 144/245 A |
| 4,340,137 | 7/1982 | Foster . | |
| 4,413,662 | 11/1983 | Gregoire et al. | 144/245 A |
| 4,462,443 | 7/1984 | Allen . | |

*Primary Examiner*—W. Donald Bray
*Attorney, Agent, or Firm*—Laubscher Presta & Laubscher

[57] ABSTRACT

An infeed table for delivering pieces of lumber to a planer machine is characterized by separate and independent lateral and longitudinal drive mechanisms to continuously deliver the lumber to the planer at the speed of the planer feedworks without damaging the pieces of lumber. The infeed table includes a frame having a longitudinal linebar connected therewith. A plurality of longitudinally spaced transfer chains laterally transfer pieces of lumber successively against the linebar. A plurality of independently driven press roller assemblies are connected with the frame adjacent the linebar in longitudinally spaced relation for transporting the pieces of lumber in sequence into the planer machine. A control device is connected with the roller assemblies to control the rotational speed thereof to accurately and efficiently transport successive pieces of lumber to the planer machine.

9 Claims, 3 Drawing Sheets

INFEED TABLE FOR LUMBER PLANER MACHINE

BACKGROUND OF THE INVENTION

In the treatment of raw pieces of lumber, a planer machine is used to plane one or more faces of a pre-cut board. For best results, the board is fed through the planer machine at a given speed while the cutting tools thereof work on the surfaces of the board. In order to maximize the output of the planer machine, it is desirable to continuously feed a steady stream of boards to the planer. The present invention relates to an automatic infeed table for successively delivering pieces of lumber to the planer machine at the given speed of the feedworks of the planer machine.

BRIEF DESCRIPTION OF THE PRIOR ART

Lumber handling and feeding devices are well-known in the art. The primary drawbacks of the conventional devices are with regard to the drive mechanisms. Conventional planer infeed tables utilize canted screw rolls to move a work piece toward a fixed linebar and under a pineapple press roll. The work pieces are then shifted toward and into the planer machine. After the workpiece has reached the linebar, no further lateral forces are required. However, since the screw rolls also convey the work piece longitudinally, the lateral forces continue to force the work piece against the linebar, thus increasing the friction and drag on the work piece and reducing energy efficiency. Moreover, conventional infeed devices transport and accelerate the work piece in a haphazard manner with little or no control over the forces applied to the work pieces. This results in excessive damage to the pieces of lumber owing to the unnecessary shear forces applied to the lumber during handling.

The present invention was developed in order to overcome these and other drawbacks of the prior devices by providing an infeed table which accurately positions pieces of lumber laterally against a linebar and then longitudinally transports the pieces into a planer machine at a speed corresponding with the speed of the planer feedworks. With the infeed table of the invention, the forces that move the pieces of lumber laterally and those that move the pieces of lumber longitudinally are independent and easily controlled to reduce the overlap of forces when unnecessary, thereby reducing damage to the lumber while increasing energy efficiency.

SUMMARY OF THE INVENTION

Accordingly, it is a primary object of the present invention to provide an infeed table for continuously delivering successive pieces of lumber to a planer machine wherein the pieces of lumber are quickly accelerated to the speed of the planer feedworks. The infeed table includes a stationary frame having a linebar adjustably connected therewith and extending in a longitudinal direction. A plurality of longitudinally spaced laterally driven drive chains are connected with the frame for laterally transporting pieces of lumber successively against the linebar. A plurality of independently rotatably driven press roller assemblies are connected with the frame adjacent the linebar in longitudinally spaced relation for transporting the pieces of lumber longitudinally to the planer machine. Connected with the press roller assemblies is a control device for independently controlling the operation of each assembly for accurate delivery of pieces of lumber of various size.

According to another object of the invention, each roller assembly is adjustable vertically and longitudinally and comprises a cover bed roller and an upper press roller between which the pieces of lumber are driven.

According to a further object of the invention, the drive chains are sloped downwardly toward the line bar, with at least the forwardmost drive chain being vertically displaceable to lift the leading edge of a piece of lumber over the bed roll of the rearwardmost roller assembly.

It is yet another object of the invention to provide a hydraulic drive for independently driving the roller assemblies, the control device controlling the hydraulic drive to individually adjust the speed of rotation of said rollers to control the feed rate and torque applied to the pieces of lumber in accordance with the width and thickness thereof.

BRIEF DESCRIPTION OF THE FIGURES

Other objects and advantages of the subject invention will become apparent from a study of the following drawing when viewed in the light of the accompanying drawing, in which.

DETAILED DESCRIPTION

Figure 2:
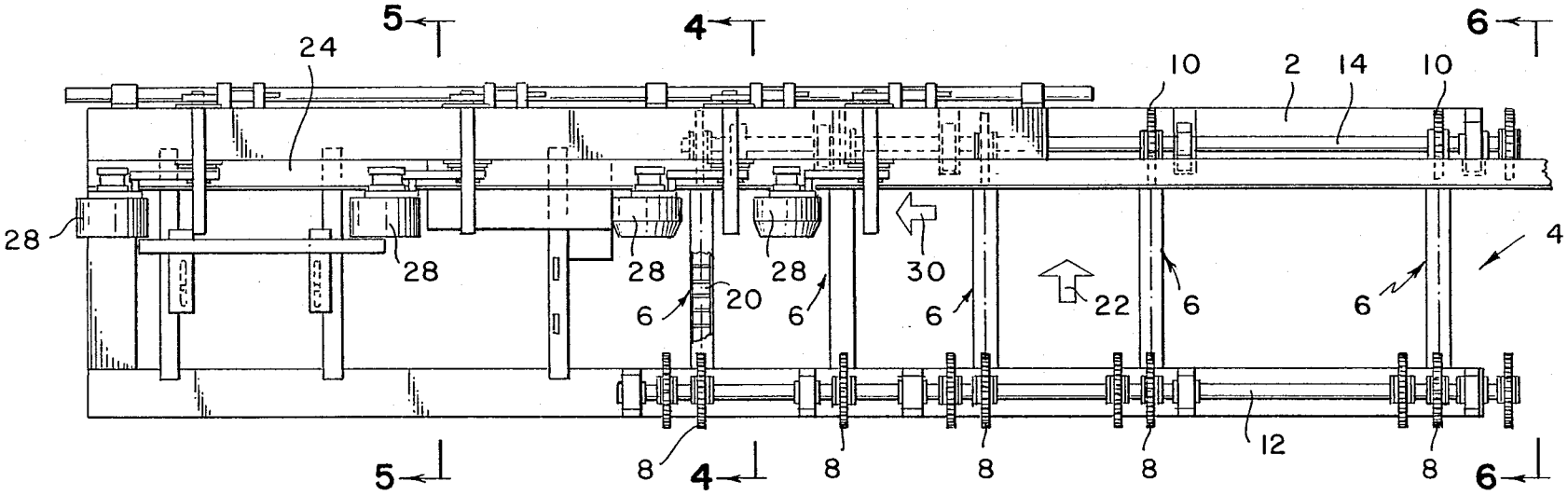
FIGS. 1, 2, and 3, are front, top, and rear plan views of the planer infeed table according to the invention
Figure 1:
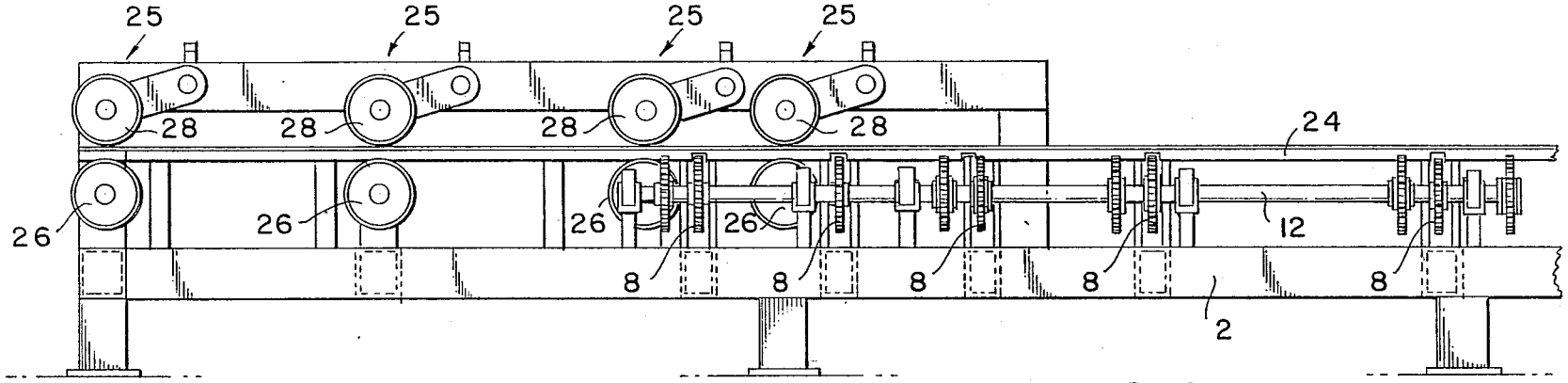
Figure 3:
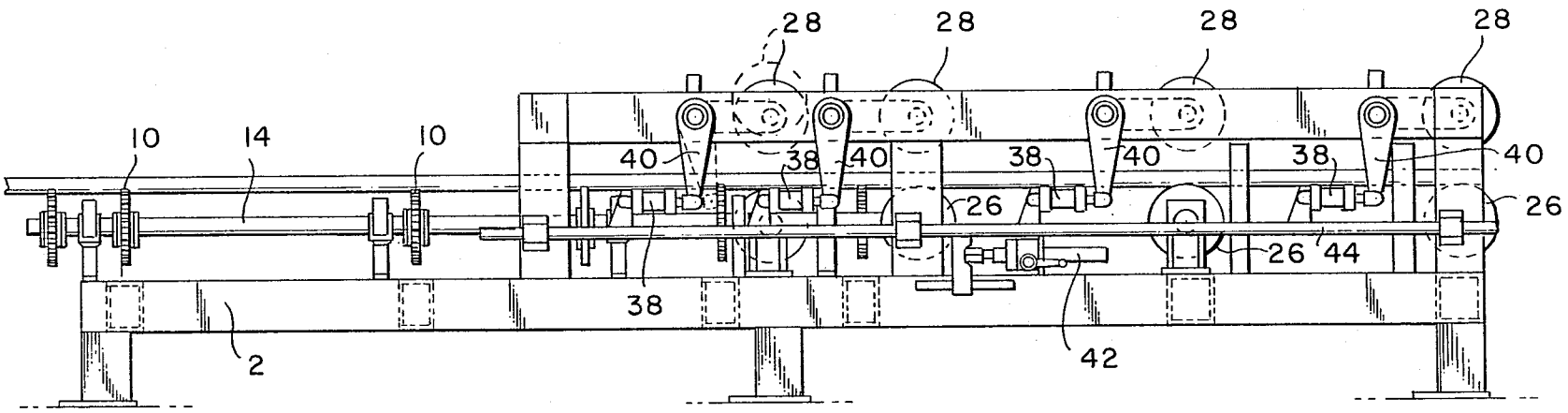
Figure 5:
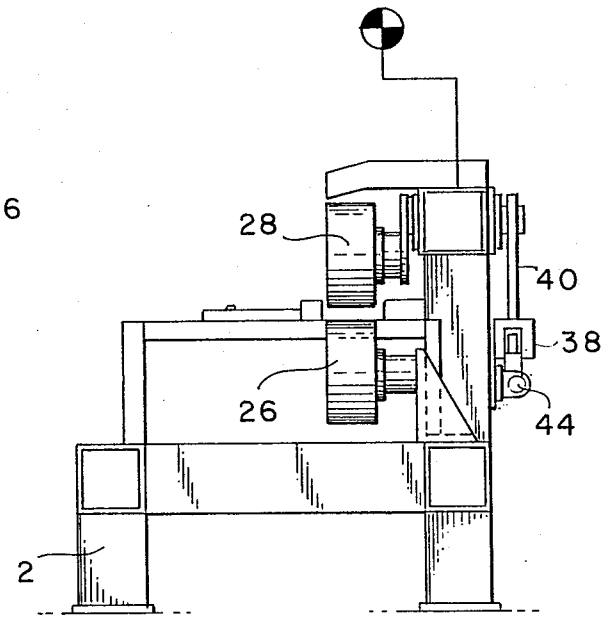
FIGS. 4, 5, and 6 are sectional views of the infeed table taken along lines 4—4, 5—5, and 6—6 of FIG. 2.

Referring initially to FIGS. 1–3, the planer infeed table according to the invention will be described. The table includes a stationary frame 2 which rests on the floor of a lumber mill or the like. Rough pieces of lumber (not shown) such as boards cut from a log are handled by the infeed table for accurate delivery into a planer machine wherein at least one surface of each board is treated by the planer machine.

Figure 6:
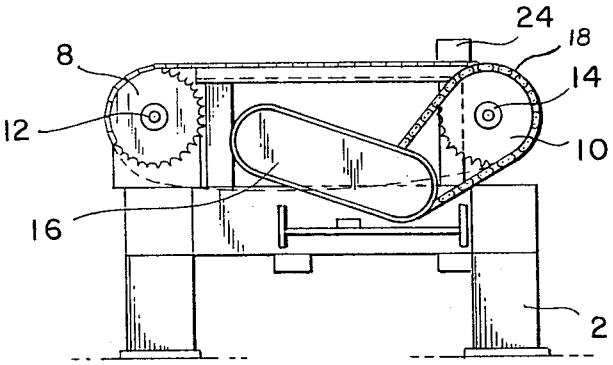

The boards are placed on a horizontal support portion 4 of the frame and extend generally longitudinally relative thereto. A plurality of laterally extending transfer chains 6 are connected with the frame. As shown in FIG. 2, the chains are spaced longitudinally along the rear portion of the frame. The chains are each connected with front and rear drive sprockets 8, 10 mounted on front and rear rods 12, 14. A motor 16 is connected with a rear sprocket 10 by a link chain 18 as shown in FIG. 6 to drive the transfer chains at a predetermined speed. The chains include projections 20 as shown in FIG. 2 which engage the lower edges of the rough pieces of lumber to transport the pieces of lumber laterally as shown by the arrow 22.

A linebar 24 is connected with the frame 2 and extends longitudinally along one side of the frame. The linebar is preferably manually adjustable to accommodate boards of different thickness. The transfer chains, which are sloped downwardly toward the linebar, continuously transfer the boards successively against the linebar which acts as a stop to ensure that the boards are accurately aligned longitudinally.

Figure 4:
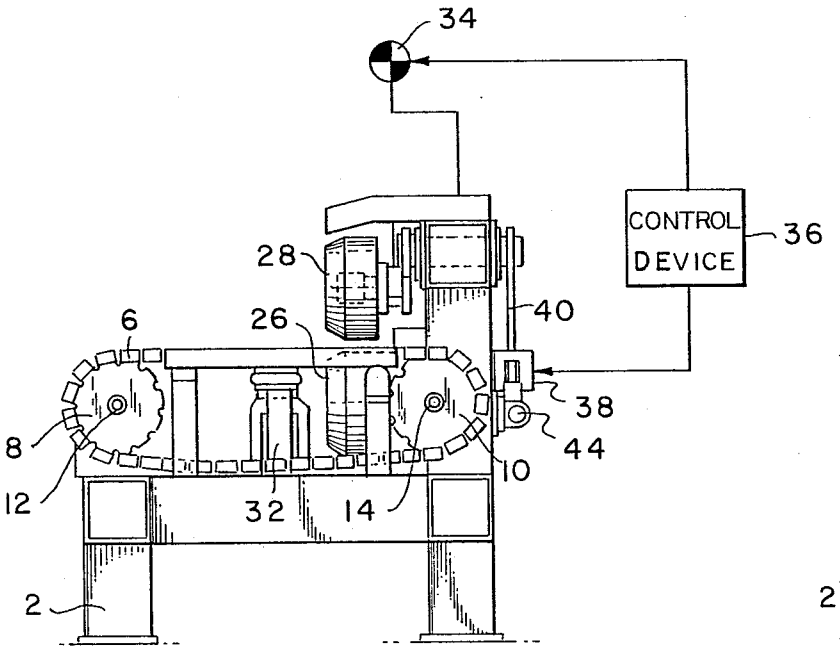

A plurality of press roller assemblies 25 are connected with the frame 2 adjacent the linebar 24. Like the transfer chains, the press roller assemblies are arranged in longitudinally spaced relation. Each press roller assembly includes a lower bed roller 26 and upper press roller 28 which are vertically spaced to allow a board to be driven therebetween for longitudinal movement as shown by the arrow 30 into the planer machine. As shown in FIGS. 1 and 2, the two most forward transfer chains straddle the rearwardmost roller assembly. Accordingly, the two forwardmost transfer chains include a vertical displacement piston 32 as shown in FIG. 4 for raising the transfer chain. In this manner, the leading edge of the laterally transferred piece of lumber is lifted over the bed roller of the rear roller assembly, whereby the leading edge of the piece of lumber is gripped between the press and bed rollers for longitudinal transport through the other roller assemblies and into the planer machine.

The bed and press rollers of each roller assembly are rotated by a hydraulic drive circuit 34 under control of a control device 36 shown schematically in FIG. 4. The rollers of each assembly are driven independently to accurately control the acceleration and longitudinal speed of each board to match the speed of the feedworks of the planer machine, whereby the pieces of lumber are efficiently machined by the planer machine with a minimal degree of torque and shear forces being applied to each board. Dedicated air cylinders 38 activate the upper press rollers 28 via a linkage 40 as shown in FIG. 3. The air cylinders, which are also operated by the control device 36 are adjustable to adjust the holddown pressure applied by the upper press roller 28. All of the upper press rollers are manually adjustable in elevation as a unit via a screw mechanism 42 connected with the frame. The screw mechanism laterally displaces a shaft 44 with which the air cylinders 38 are connected. Thus as the air cylinders are laterally displaced, the associated upper press rollers are raised or lowered.

In operation, the infeed table receives boards, dimension lumber, or timber from a conventional lumber transfer device and the transfer chains convey the boards in a single layer laterally against the linebar and then longitudinally in single file into the planer machine feedworks system.

Since all of the transfer chains are sloped downwardly toward the linebar, gravity assists the quick lateral acceleration of each workpiece causing each successive board to index very quickly behind the preceding board and ultimately against the linebar. Singularly against the linebar, each work piece is quickly accelerated to the desired speed in the longitudinal direction toward the planer machine by the press roller assemblies. Upon reaching the trailing end of the preceding workpiece, the successive piece automatically assumes the speed of the planer feedworks owing to the unique hydraulic drive system. The press roller assemblies are independently driven by the hydraulic drive system under logic control from a control device providing easy adjustment of feed rate and torque as desired for width and thickness variations sensed by optical sensors. With the infeed table of the present invention, the pieces of lumber are consistently conveyed to the feedworks of the planer machine at a high piece count rate. Moreover, the forces that move the pieces of lumber laterally and the forces that move the pieces of lumber longitudinally are separate and independent, as well as easily controlled to reduce both of the drive forces to a minimum and to eliminate overlapping of drive forces when unnecessary.

The accurate control of the independent lateral and longitudinal drive forces reduces shock and breakage of low grade lumber owing to the reduction of excessive shear. Furthermore, the infeed table of the invention is less complex than conventional planer infeed devices since it has less moving parts and because all replaceable parts are inexpensive and readily accessible.

Finally, because the press roller assemblies are adjustable in elevation as a unit, set up time from product to product is reduced. Also, all drive systems, pressing rolls, and sequences are easily adjustable for changeover to products with different geometric shapes and sizes.

While in accordance with the provisions of the patent statutes the preferred forms and embodiments of the invention have been illustrated and described, it will be apparent to those of ordinary skill in the art that various changes and modifications may be made without deviating from the inventive concepts set forth above.

What is claimed is:

1. An infeed table for delivering pieces of lumber to a planer machine, comprising
   (a) a stationary frame;
   (b) a linebar adjustably connected with said frame and extending in a longitudinal direction;
   (c) chain drive means connected with said frame for laterally transferring pieces of lumber successively against said linebar;
   (d) a plurality of independently rotatably driven press roller assemblies connected with said frame adjacent said linebar in longitudinally spaced relation for transporting the pieces of lumber longitudinally to the planer machine; and
   (e) control means connected with said press roller assemblies for independently controlling the rotational speed of said press roller assemblies, whereby said pieces of lumber are quickly accelerated in said longitudinal direction for successive transport to the planer machine at a speed corresponding with the speed of the planer feedworks.

2. Apparatus as defined in claim 1, wherein each of said press roller assemblies comprise a lower bed roller and a spaced upper press roller, said pieces of lumber passing between said bed and press rollers.

3. Apparatus as defined in claim 2, wherein said chain drive means comprise a plurality of laterally driven chainways which engage the bottom edges of the pieces of lumber, said chainways being arranged in longitudinally spaced relation.

4. Apparatus as defined in claim 3, wherein at least one of said chainways toward the forward planer machine end of said frame is vertically displaceable to lift the leading edge of the pieces of lumber over said lower bed rollers of the rearwardmost roller assemblies.

5. Apparatus as defined in claim 4, wherein said chainways are sloped downwardly in the direction of said linebar.

6. Apparatus as defined in claim 5, and further comprising hydraulic drive means connected with said control means for independently driving said roller assemblies.

7. Apparatus as defined in claim 6, wherein said control means controls said hydraulic drive means to individually adjust the feed rate and torque applied by said roller assemblies to the pieces of lumber in accordance with the width and thickness thereof.

8. Apparatus as defined in claim 7, and further comprising air cylinder means connecting each of said upper pressing rollers with said frame, said air cylinder means being individually adjustable to vary the holddown pressure applied by said press rollers.

9. Apparatus as defined in claim 8, and further comprising screw means connected between said air cylinder means and said frame for vertically displacing said upper press rollers relative to said lower bed rollers to accommodate pieces of lumber of various thickness.

* * * * *